US012146307B2

(12) United States Patent
Rathammer

(10) Patent No.: US 12,146,307 B2
(45) Date of Patent: Nov. 19, 2024

(54) ARRANGEMENT FOR THE INSTALLATION AND MOUNTING OF A WASH BASIN

(71) Applicants: Andre Rathammer, Vienna (AT); Harald Fechter, Vienna (AT)

(72) Inventor: Andre Rathammer, Vienna (AT)

(73) Assignees: Andre Rathammer, Vienna (AT); Harald Fechter, Vienna (AT)

( * ) Notice: Subject to any disclaimer, the term of this patent is extended or adjusted under 35 U.S.C. 154(b) by 188 days.

(21) Appl. No.: 17/783,996

(22) PCT Filed: Dec. 7, 2020

(86) PCT No.: PCT/EP2020/084864
§ 371 (c)(1),
(2) Date: Jun. 9, 2022

(87) PCT Pub. No.: WO2021/116012
PCT Pub. Date: Jun. 17, 2021

(65) Prior Publication Data

US 2023/0011469 A1 Jan. 12, 2023

(30) Foreign Application Priority Data

Dec. 10, 2019 (AT) ..... A51080/2019

(51) Int. Cl.
*E03C 1/322* (2006.01)
*E03C 1/02* (2006.01)

(52) U.S. Cl.
CPC ..... *E03C 1/322* (2013.01); *E03C 1/021* (2013.01)

(58) Field of Classification Search
CPC ..... E03C 1/021; E03C 1/322; A47K 1/05
(Continued)

(56) References Cited

U.S. PATENT DOCUMENTS 8,739,326 B2 * 6/2014 Staubli ..... E03D 11/143 4/643
2019/0226188 A1 7/2019 Rathammer
2022/0220713 A1 * 7/2022 Roediger ..... E03C 1/322

FOREIGN PATENT DOCUMENTS

DE 1093741 B 11/1960
DE 8714318 U1 4/1988
(Continued)

OTHER PUBLICATIONS

PCT Search Report and Written Opinion dated Mar. 12, 2021 of Application No. PCT/EP2020/084864.

*Primary Examiner* — Tuan N Nguyen
(74) *Attorney, Agent, or Firm* — Gordon & Jacobson, P.C.

(57) ABSTRACT

An arrangement for use with a washbasin. The arrangement includes a mounting box configured to fasten to a wall or to a mounting frame. The mounting box includes connections for water supply and water drain and fasteners configured to fasten to the mounting box for mounting the washbasin to the wall or mounting frame. The arrangement further includes holding and guide elements configured to hold the washbasin while mounting the washbasin to the mounting box. The holding and guide elements comprise at least two drawer slides each having a fixed part and a moveable part. The fixed part is fixedly connected to the mounting box. The moveable part is configured to directly connect to the washbasin within a recess that is defined by the washbasin and disposed on a backside of the washbasin. The moveable part is further configured to move with the washbasin relative to the fixed part.

14 Claims, 5 Drawing Sheets

(58) Field of Classification Search
USPC ..... 4/619, 643, 645, 647–649, 252.2, 252.3
See application file for complete search history.

(56) References Cited

FOREIGN PATENT DOCUMENTS

| | | | |
|---|---|---|---|
| DE | 9216799 | U1 | 3/1993 |
| DE | 29912636 | U1 | 10/1999 |
| EP | 0408500 | A2 | 1/1991 |
| EP | 0864701 | A2 | 9/1998 |
| EP | 1154084 | A2 | 11/2001 |
| EP | 1593783 | A1 | 11/2005 |
| GB | 1295072 | | 11/1972 |

* cited by examiner

A-A

D-D

B-B

E-E

ARRANGEMENT FOR THE INSTALLATION AND MOUNTING OF A WASH BASIN

CROSS-REFERENCE TO RELATED APPLICATION(S)

This application is the National Stage of International Patent Application No. PCT/EP2020/084864, filed on Dec. 7, 2020, which claims priority from Austrian Patent Application No. A51080/2019 filed on Dec. 10, 2019, both of which are herein incorporated by reference in their entireties.

BACKGROUND

The invention relates to an arrangement for installing and mounting a washbasin, wherein a mounting box that can be fastened to a wall or to a mounting frame is provided, the mounting box providing the connections for water supply and water drain, and having a fastening means for fastening the washbasin.

Arrangements of this kind serve to mount washbasins or similar devices as easily, fast and cost-efficiently as possible on the wall and to provide the necessary connections for water inlet and outlet. The washbasins known to this date have the disadvantage that they are relatively complex to mount and that the fittings arranged underneath the washbasin such as connection taps, supply and drain hoses, siphons etc. are freely visible and therefore visually unattractive.

The provision of separate covers for the wall connections and the siphon of the water drain or covers connected to the washbasin is known. These covers require either specially designed vanity units or convex portions at the bottom of the washbasin, which make the washbasins very bulky and heavy. The mounting of the washbasins consists of a whole series of steps and is complex.

SUMMARY

It is therefore an object of the present invention to provide an arrangement of a washbasin without the above mentioned disadvantages. In particular, the object is to hide the connections of the washbasin without additional cover elements. This concerns not only the water supply connections, but also the drain. The object is also to avoid the use of additional materials such as extension hoses, separate siphons etc., which are otherwise necessary for the mounting. Another object is not to obstruct the provision of vanity units underneath washbasins by the connections. A further object is to provide accessibility to the disabled and to make vandalism more difficult.

A particular object is to be able to arrange washbasins with a very flat cross-sectional profile, while still providing the necessary stability for fastening.

An arrangement of this type has already been proposed in EP 3 523 486. However, it was found that changes in the fastening structure can be advantageous, making mounting easier and faster.

This is especially advantageous if a plurality of similar washbasins has to be mounted, e.g. in a big residential or hotel complex. Thanks to the fast mounting of the washbasins according to the invention significant cost savings are possible. No drilling is required for mounting, so that the risk of drilling into pipes is avoided. The mounting can be carried out by a worker.

During construction, the preassembled elements, such as mounting frame with mounting box as flush-mounted box, which are already provided with all connections and fastening points, are installed. The washbasins may also be delivered completely prefabricated and connected and put into operation by simple means.

The arrangement according to the invention is preferably characterized in that the arrangement has holding and guide elements for receiving mainly vertical forces and fastening elements for fastening to a wall or to a mounting frame. The holding and guide elements have preferably at least two drawer slides, wherein the fixed part of the drawer slide is fixedly connected to the mounting box and the part of the drawer slide which is movable with the washbasin is connected or connectable to the washbasin.

Optionally, it is provided that the arrangement has holding and guide elements for receiving mainly vertical forces and for guiding during mounting and fastening elements for fastening to a wall or to a mounting frame.

The holding and guide elements may comprise at least two drawer slides, wherein the fixed part of the drawer slide is fixedly connected to the mounting box and the part of the drawer slide which is movable with the washbasin is connected or connectable to the washbasin.

Furthermore, the fastening elements may have one or more clamping elements, which are connected or connectable on the one hand to the mounting box and on the other hand to the washbasin, whereby the washbasin can be clamped in the direction of the wall or the mounting frame.

According to a further feature of the invention, a back plate, on which clamping elements are displaceably arranged, is arranged and fastened in a recess of the back side of the washbasin, wherein the clamping elements comprise a clamping anchor which can be connected to the mounting box.

Preferably, the clamping anchor has a traction element at the end region adjacent to the washbasin and a clamping wedge is provided between the traction element and the back plate. The clamping wedge is displaceable along the back plate by means of an advancing element. The advancing element may be a a screw element, which is rotatable in a thread of a threaded tab.

Optionally, the clamping anchor has a screw bolt which can be fastened to the mounting box and a screw sleeve which can be screwed onto the screw bolt, wherein the screw sleeve has the traction element.

The arrangement is further characterized in that the back plate is connected to the washbasin by means of fastening bolts.

According to a further feature of the invention, the part of the drawer slide which is movable with the washbasin is formed as a tube, in particular as a square tube, into which the fixed part of the drawer slide connected to the mounting box can be inserted.

The arrangement is optionally characterized in that a sliding element, preferably sliding rollers, is provided on the movable part of the drawer slide in order to facilitate the displacement of the washbasin.

Further features of the invention can be found in the following description, the patent claims and the drawings.

BRIEF DESCRIPTION OF THE DRAWINGS

In the following, the invention is explained in more detail by way of example with reference to the figures.

DETAILED DESCRIPTION OF THE PREFERRED EMBODIMENTS

Figure 1:
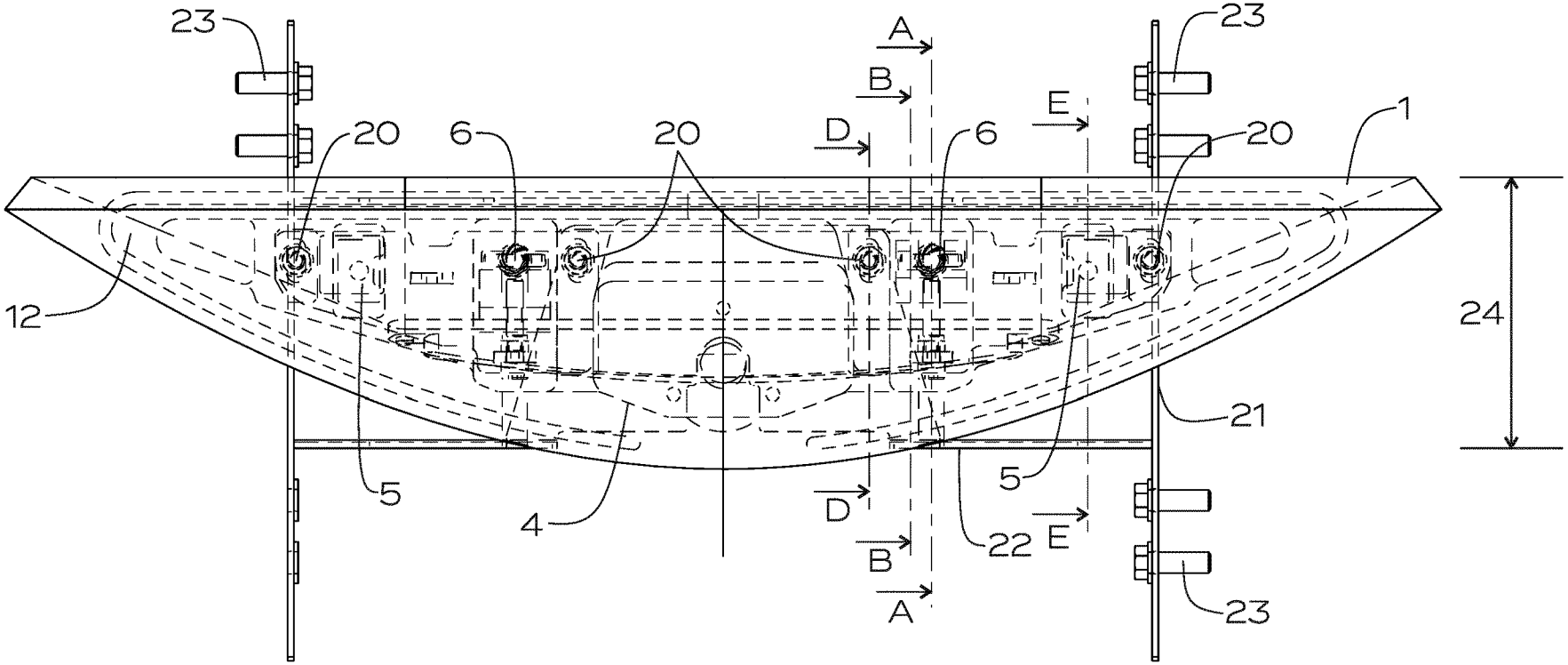
FIG. 1 shows the front view of a washbasin, wherein the wall-side construction elements installed in the wall or a mounting frame are also shown.

FIG. 1 shows a phantom front view of a washbasin 1, which is fastened at its back side to the mounting frame 3. The mounting frame 3, with its vertical struts 21 and cross struts 22, is preferably an integral part of a wall 2, which can be made in lightweight construction, for example. The mounting frame 3 and the mounting box 4 connected to it may be also built into the wall in a permanent construction. As explained later, the mounting box 4 corresponds to the conventional flush-mounted box, in which all connections are provided, such as supply water pipes, water drainage pipe and siphon.

For the installation of the wall 2 provided here in lightweight construction, the screws 23 can be used to connect the mounting frame 3 to the vertical beams 32 (see e.g. FIG. 7) of the wall construction. Such walls 2 are usually clad with plate elements, such as gypsum board.

In FIG. 1, two holding and guide elements 5, which are preferably formed as drawer slides, are shown in phantom. Furthermore, FIG. 1 shows fastening bolts 20, by which a stable back plate 12 is connected to the washbasin. Furthermore, fastening elements 6 are shown, by which the washbasin 1 can be fastened to the mounting box 4 anchored in the wall or to the mounting frame 3.

The body of the washbasin may be made in the usual way from ceramic or other materials such as porcelain, metal, natural stone, plastic or artificial stone. Advantageously, the washbasin 1 may have a low height 24 and yet the washbasin 1 completely covers the mounting box 4 with all its fittings, so that it is not visible when the washbasin 1 is mounted.

Figure 2:
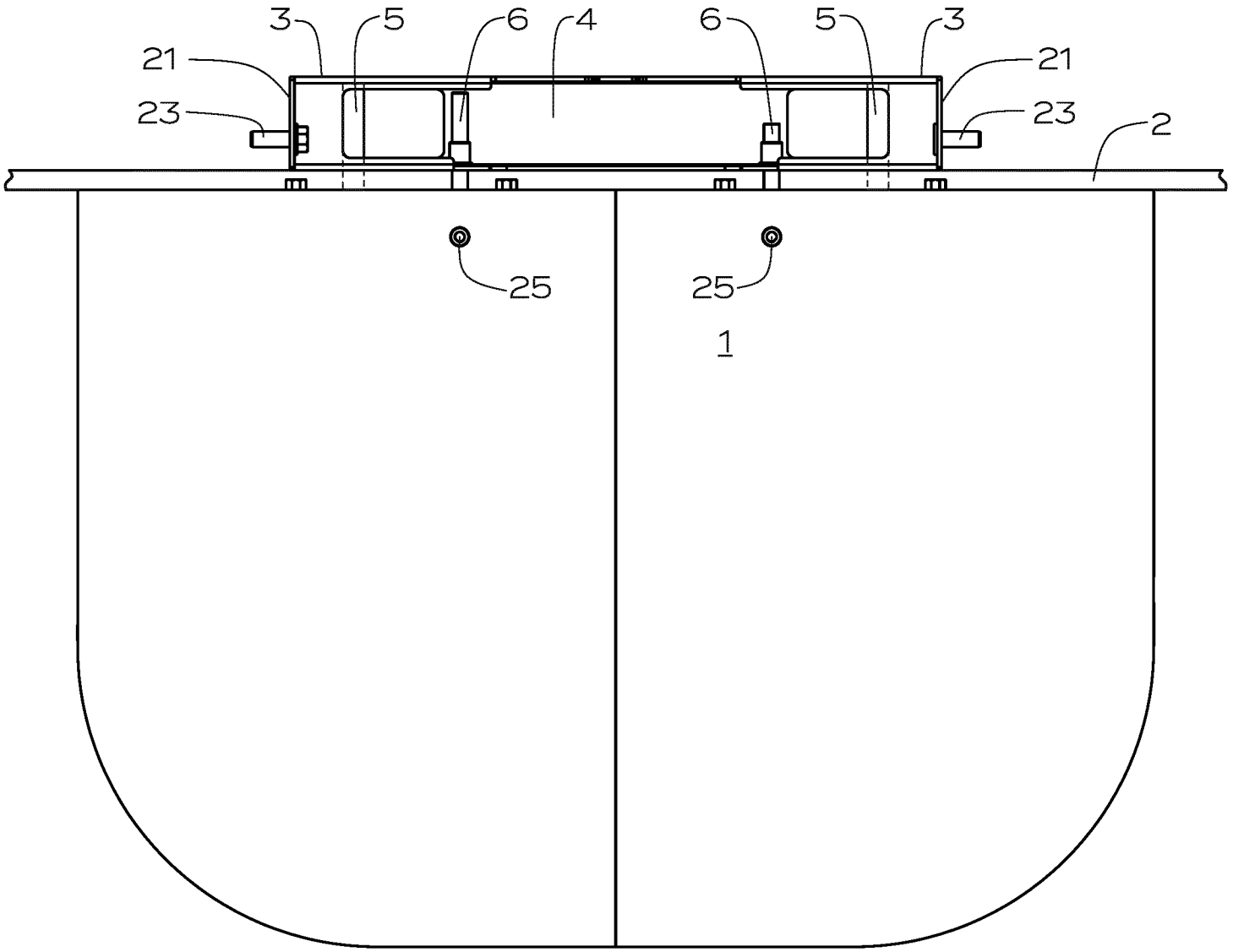
FIG. 2 shows a bottom view of the washbasin fastened to the mounting box.

FIG. 2 shows the bottom view of the washbasin 1 with the mounting box 4, wherein two screw holes 25 are shown in the washbasin 1, through which a screwing tool can be inserted to the clamping elements 9 shown below. Examples for screwing tools are flat or crosshead screwdrivers or hex keys, for example.

The mounting box 4 usually comprises the water connections and the siphon for water drainage, wherein said parts are not shown here. The holding and guide elements 5 and the fastening elements 6 arranged in the mounting box 4 are shown.

FIGS. 3, 4, 5 and 7 show sections along lines A-A, B-B, D-D and E-E in FIG. 1.

The washbasin 1 has a flat continuous recess 26 on its back side 11, in which a stable back plate 12 is fastened by means of the fastening bolts 20. The fastening bolts 20 are fixedly connected to the washbasin and, for example, screwed into the material of the washbasin or glued or clamped in the respective bores 27. The back plate 12 is tightened by means of the screw nut 28. The back plate 12 is fixedly connected to the washbasin 1 by means of four such fastening bolts 20 and gives the washbasin 1 the necessary strength during and after mounting. The position of the back plate 12 in the recess 10 is adjustable in height, as the fastening holes 36 are elongated holes (see also FIG. 6).

Figure 4:
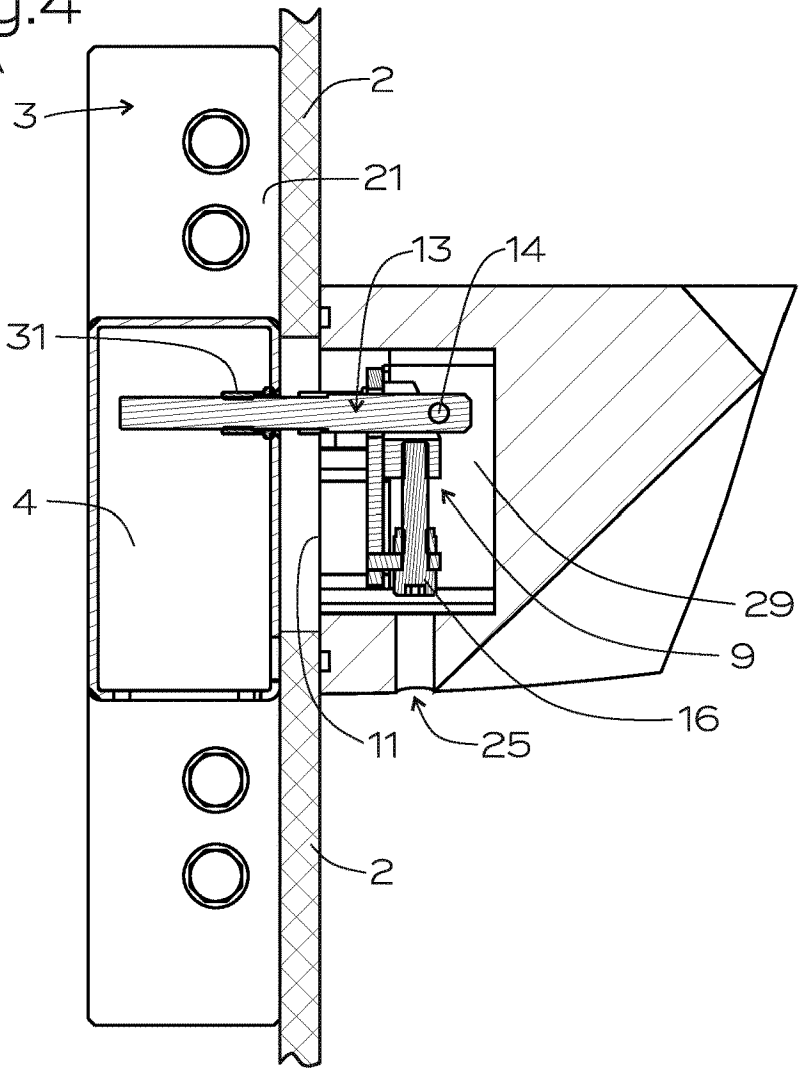
FIG. 4 shows the section A-A in FIG. 1.
Figure 3:
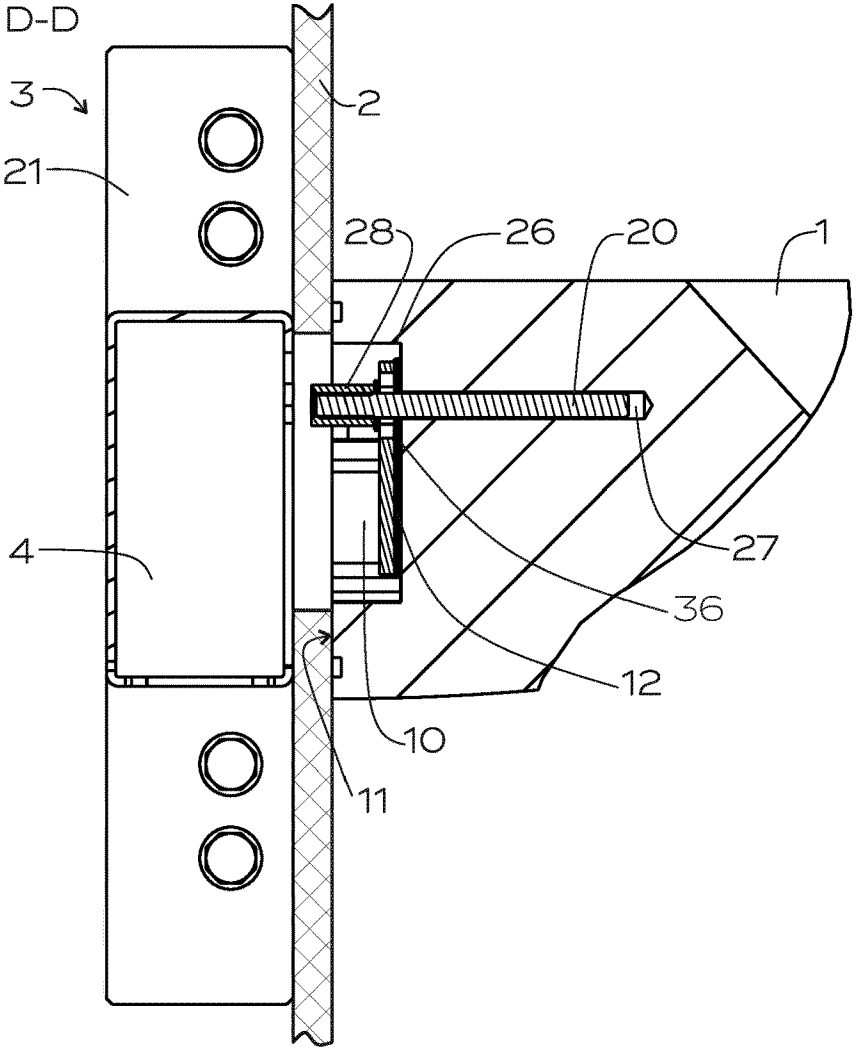
FIG. 3 shows the section along line D-D in FIG. 1.
Figure 6:
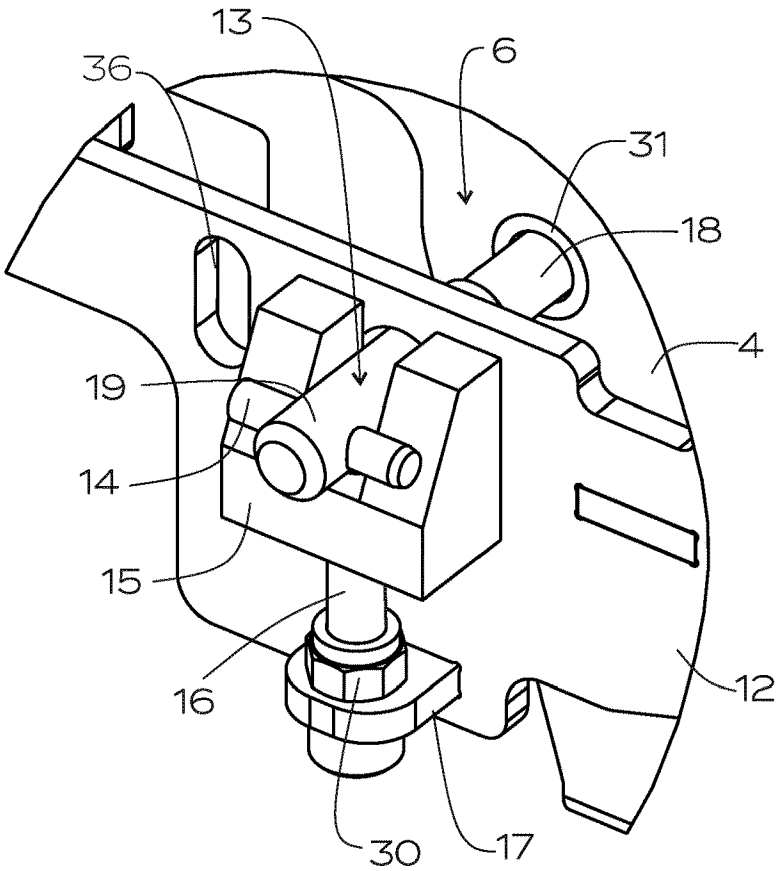
FIG. 6 shows a broken diagonal view of a detail of the fastening elements.
Figure 5:
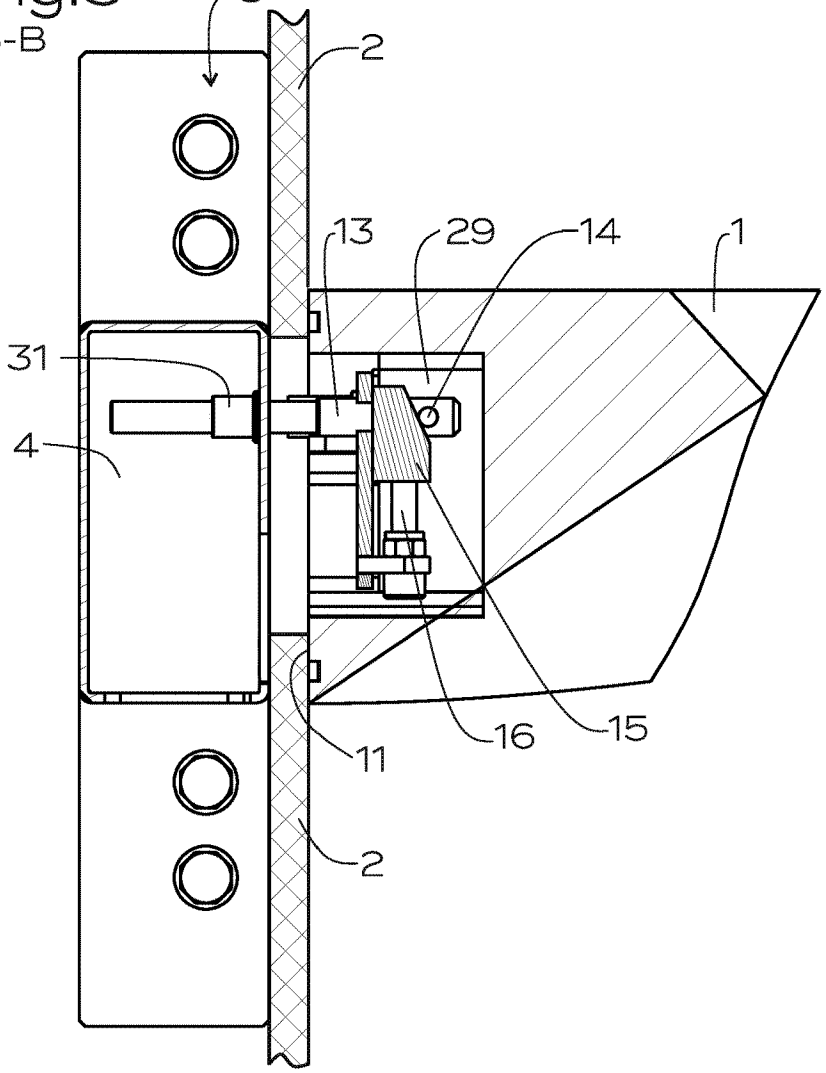
FIG. 5 shows the section B-B in FIG. 1.

FIGS. 4, 5 and 6 illustrate the construction elements for clamping the washbasin 1 on the mounting frame 3. In a widened recess 29 of the washbasin 1, a clamping wedge 15 is provided on the back plate 12, which can be pushed upwards by means of the advancing element 16. The clamping wedge 15 runs with its wedge surface onto the traction element 14 and thereby moves the clamping anchor 13 into the widened recess 29 in such a way that the washbasin 1 is pulled firmly with its back side 11 against the mounting frame 3 or the wall 2 arranged in front of it.

The structure and functioning of this clamping device is best shown in FIG. 6. The advancing element 16 is, for example, a threaded bolt, that runs in a threaded sleeve 30 that is fastened to a threaded tab 17. The threaded sleeve 30 is accessible from below through the screw holes 25 of the washbasin 1 (see FIG. 2). The clamping anchor 13 comprises a screw sleeve 19 having the traction element 14 in the form of a transverse bolt. The inner thread of the screw sleeve 19 is engaged with the thread of the screw bolt 18, which is screwed into a thread 31, which is located in the wall of the mounting box 4.

This arrangement of the screw sleeve 19, screw bolt 18 and thread 31 allows the adjustment of the clamping anchor 13 to adapt to the measurements of the wall 2 and the washbasin 1.

Figure 7:
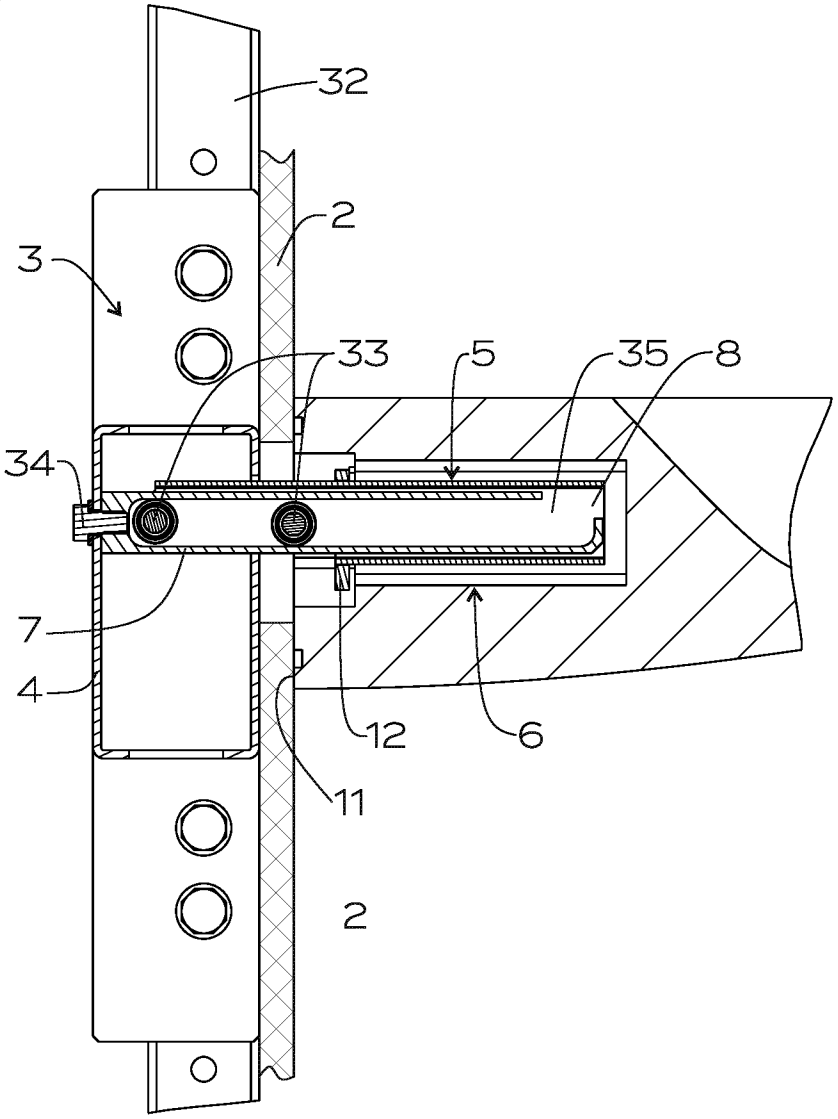
FIG. 7 shows the arrangement of the holding and guide means in the section E-E.

FIG. 7 shows the section along line E-E in FIG. 1 through one of the holding and guide elements 5.

These serve to receive and hold the washbasin 1 at a distance from the wall 2, in order to connect the water pipes from the mounting box 4 to the connections of the fittings of the washbasin at this distance. Further, the holding and guide elements 5 allow the targeted and dimensionally accurate mounting of the water drainage connection of the washbasin 1 in the receiving pipe of the siphon, which is located partly in the mounting box 4 and partly in the wall construction (the connections and the siphon are not shown).

The holding and guide element 5 shown in FIG. 7 is preferably a drawer slide.

The fixed part 7 of the drawer slide is fixedly connected to the mounting box 4, for example by the screw 34 and/or by welding. The part 7 has a laterally open C-shaped cross section and has an entry opening 35 at the front end to allow the entry of the sliding rollers 33.

The sliding rollers 33 are positioned laterally in the movable part 8 of the drawer slide, thereby allowing the washbasin 1 to be pushed in smoothly up to the wall stop. The movable part 8 of the drawer slide is preferably formed as a square tube, which is located in a recess 10 of the washbasin 1, is connected to the back plate 12, is preferably welded, and projects over the back side 11 of the washbasin 1.

LIST OF REFERENCE NUMERALS

1 Washbasin
2 Wall
3 Mounting frame
4 Mounting box
5 Holding and guide elements
6 Fastening elements
7 Fixed part of the drawer slide
8 Movable part of the drawer slide
9 Clamping elements

10 Recess
11 Back side
12 Back plate
13 Clamping anchor
14 Traction element
15 Clamping wedge
16 Advancing element
17 Threaded tab
18 Screw bolt
19 Screw sleeve
20 Fastening bolt
21 Vertical strut
22 Cross strut
23 Screw
24 Height
25 Screw holes
26 Flat recess
27 Bore
28 Screw nut

The invention claimed is:

1. An arrangement for use with a washbasin, the arrangement comprising:

a mounting box configured to fasten to a wall or to a mounting frame, the mounting box including connections for water supply and water drain and fastening means configured to fasten the washbasin to the mounting box for mounting the washbasin to the wall or mounting frame; and holding and guide elements configured to hold the washbasin and guide the washbasin while mounting the washbasin to the mounting box, wherein the holding and guide elements comprise at least two drawer slides each having a fixed part and a moveable part, wherein the fixed part is fixedly connected to the mounting box, wherein the moveable part is configured to directly connect to the washbasin within a recess that is defined by the washbasin and disposed on a backside of the washbasin, and wherein the moveable part is further configured to move with the washbasin relative to the fixed part.

2. The arrangement according to claim 1, wherein the fastening means comprises at least one clamping element, the clamping element configured to connect to the mounting box and to the washbasin, whereby the clamping element is configured to clamp the washbasin in the direction of the wall or the mounting frame.

3. The arrangement according to claim 2, further comprising a back plate that supports the at least one clamping element, wherein the back plate is configured to be operably disposed within the recess disposed on the back side of the washbasin, and wherein the at least one clamping element comprises a clamping anchor configured to connect to the mounting box.

4. The arrangement according to claim 3, wherein the clamping anchor has a traction element and a clamping wedge, wherein the traction element is configured to be operably disposed adjacent to the washbasin, and wherein the clamping wedge is disposed between the traction element and the back plate.

5. The arrangement according to claim 4, wherein the clamping wedge is displaceable along the back plate by means of an advancing element.

6. The arrangement according to claim 5, wherein the advancing element is a screw element which is rotatable in a thread of a threaded tab.

7. The arrangement according to claim 4, wherein the clamping anchor has a screw bolt configured to fasten to the mounting box and a screw sleeve screwed onto the screw bolt, and wherein the screw sleeve has the traction element.

8. The arrangement according to claim 3, wherein the back plate is connected to the washbasin by means of fastening bolts.

9. The arrangement according to claim 3, wherein the back plate is adjustable in height in the recess.

10. The arrangement according to claim 9, wherein the back plate has elongated fastening holes for the fastening bolts.

11. The arrangement according to claim 1, wherein the moveable part comprises a square tube configured to receive the fixed part.

12. The arrangement according to claim 1, wherein the at least two drawer slides each further comprise at least one sliding element configured to facilitate displacement of the washbasin.

13. The arrangement according to claim 12, wherein the sliding element comprises at least one sliding roller.

14. The arrangement according to claim 12, wherein the sliding element is provided on the movable part.

* * * * *